United States Patent [19]

Shamlian

[11] 4,203,150

[45] May 13, 1980

[54] RECHARGEABLE MODULAR COMPONENT LIGHT WITH QUICK-DISCONNECT CONNECTION

[76] Inventor: Ralph B. Shamlian, 3549 Haven Ave. #E, Menlo Park, Calif. 94025

[21] Appl. No.: 843,288

[22] Filed: Oct. 18, 1977

[51] Int. Cl.[2] ..... F21C 9/00

[52] U.S. Cl. ..... 362/183; 362/202; 362/226

[58] Field of Search ..... 362/183, 189, 194, 196, 362/201, 202, 226

[56] References Cited

U.S. PATENT DOCUMENTS

| | | | |
|---|---|---|---|
| 1,905,774 | 4/1933 | Wheat | 362/183 |
| 2,427,017 | 9/1947 | Miller . | |
| 2,963,573 | 12/1960 | Ziegenbien | 362/183 |
| 3,393,312 | 7/1968 | Dahl | 362/183 X |
| 3,441,730 | 4/1969 | Doring et al. | 362/183 |
| 3,517,185 | 6/1970 | Moore et al. . | |
| 3,555,394 | 1/1971 | Bramer et al. | 362/183 |
| 3,703,634 | 11/1972 | Bucky | 362/183 |
| 3,794,825 | 2/1974 | Krupansky . | |
| 3,829,676 | 8/1974 | Nelson et al. | 362/183 |
| 3,835,272 | 9/1974 | Wisenbaker . | |
| 4,092,580 | 5/1978 | Prinsze | 362/183 X |
| 4,114,187 | 9/1978 | Uke | 362/183 X |

*Primary Examiner*—Peter A. Nelson

*Attorney, Agent, or Firm*—Le blanc, Nolan, Shur & Nies

[57] ABSTRACT

A rechargeable, hand held, battery powered light having modular components snap-connected together for simplicity of construction and ease in recharging.

9 Claims, 9 Drawing Figures

RECHARGEABLE MODULAR COMPONENT LIGHT WITH QUICK-DISCONNECT CONNECTION

BACKGROUND OF THE INVENTION

This invention relates to hand held, small, battery-operated, protable electric lights or flashlights and more particularly to a small, watertight rechargeable light employing a lens cap switch and adapted for underwater use or for above water use in any damp or otherwise hostile environment.

Rechargeable lights per se are old, as are rechargeable lights especially adapted for underwater use. However, these lights suffer from several notable deficiencies. Most require external switch components that deteriorate or malfunction eventually, or require through-casing switch components that leak sonner or later. Prior art lights have internal wiring which is easily broken, particularly when batteries are removed for recharging or replacement. Furthermore, such prior art lights are excessively weighty and bulky, making them difficult to handle and quite expensive to manufacture.

An example of a prior art, bulky, waterproof lantern-sized flashlight is disclosed in U.S. Pat. No. 3,794,825 issued to Carl S. Krupansky. Rechargeable lights requiring complex recharging stands for mounting the entire light during recharging are illustrated in U.S. Pat. Nos. 3,517,185 issued to A. H. Moore et al and 3,829,676 issued to Norman C. Nelson et al. Rotary case component switches for flashlights are shown in prior U.S. Pat. Nos. 3,320,414 issued to C. R. Bowland and 3,835,272 issued to E. M. Wisenbaker.

A very small, single cell flashlight designed for emergency use, having a rotary case component switch and all parts hermetically sealed within the light, is disclosed in U.S. Pat. No. 2,427,017 issued to W. B. Miller. However, the prior art fails to disclose a small, compact, rechargeable water and moisture resistant light constructed of totally modular units, and including snap-connector light assembly and battery modules and a separate charger with mating snap-connectors thereby permitting very easy breakdown for battery recharging or replacement.

SUMMARY OF THE INVENTION

Accordingly, it is a principal object of the invention to provide a small, watertight compact, rechargeable modular flashlight having a light assembly module and a battery module, attached together by quick-disconnect electrical snap-fasteners, for uncomplicated disassembly of the light for recharging or replacement of the battery module.

It is another object of the invention to provide a battery frame and a charger which are connected together by electrically conductive snap-fasteners, for ease of assembly and disassembly.

It is a further object of the invention to provide a modular component light having but two casing parts, with a watertight, O-ring seal therebetween, the lens cap of the light also serving as a rotatable switch.

Still another object of the invention is to provide a modular component light having internal, snap-connector light assembly and battery modules with reversed male-female elements to prevent improper polarity connection of components.

It is still a further object of the invention to provide an exceptionally small, compact modular component light of uncomplicated construction which is easy to assemble and disassemble as well as being quite low in cost of manufacture.

Essentially, the modular component light or flashlight of the invention includes four basic elements: a casing or body; a lens cap, a battery module which is rechargeable in a preferred embodiment of the invention, and a light assembly module, snap-connected to the battery module. A conventional 110 VAC charger having mating snap-connectors for the battery is provided or a 12 VDC charger with the same connectors but modified for use with a conventional auto battery through the cigar lighter of an automobile may be used. Alternatively, non-rechargeable batteries could be used.

Further novel features and other objects of this invention will become apparent from the following detailed description, discussion and the appended claims taken in conjuction with the accompanying drawings.

BRIEF DESCRIPTION OF DRAWINGS

Preferred structural embodiments of this invention are disclosed in the accompanying drawings in which.

DESCRIPTION OF THE PREFERRED EMBODIMENTS

Figure 2:
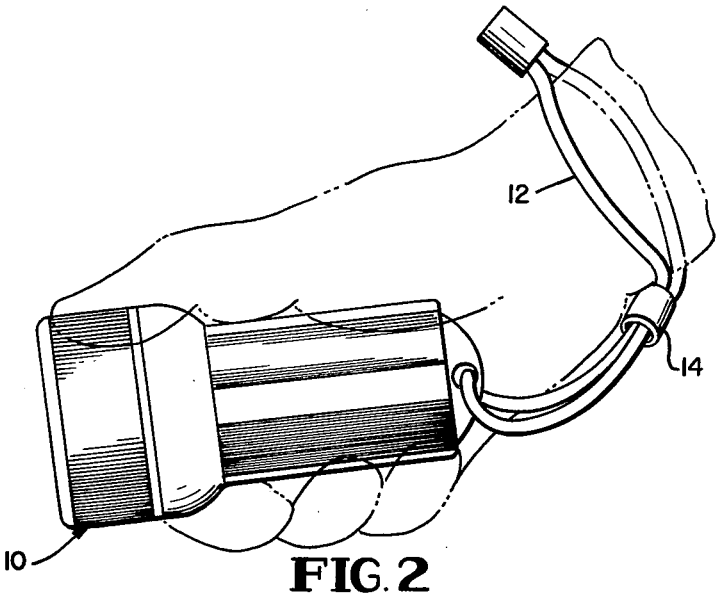
FIG. 2 is a smaller scale view of the invention in use.
Figure 6:
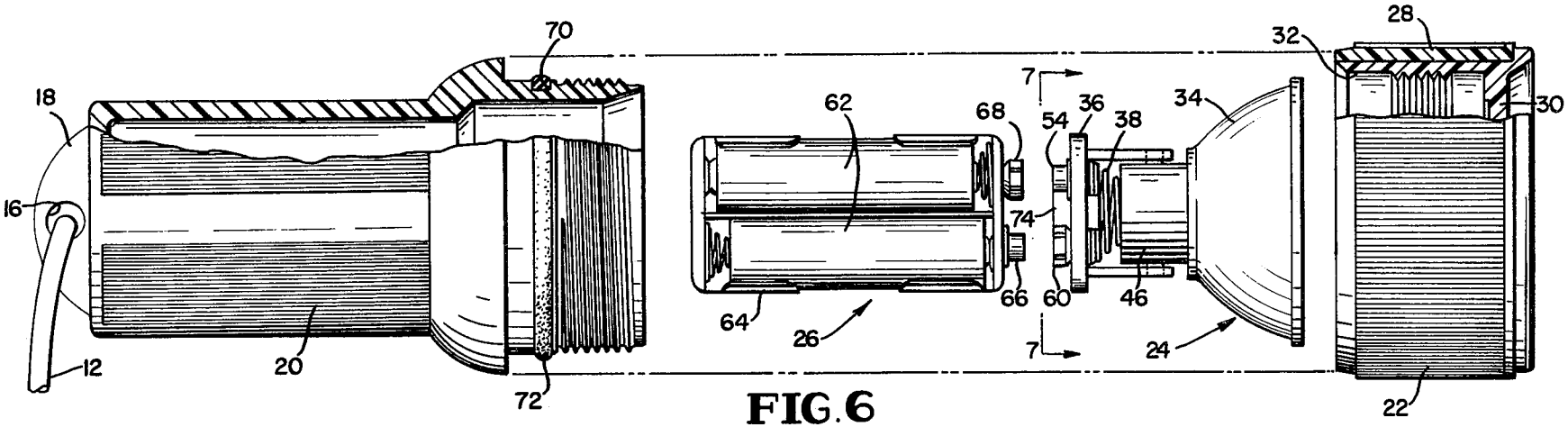
FIG. 6 is an exploded view of the invention with elements in partial section, illustrating its four principal components or modules.

The modular component light 10 of the inventon is a hand held lantern or flashlight, relatively small in size when compared with conventional lights having an equivalent light output. Light 10 may be held in one's hand very easily, as illustrated in FIG. 2 and may be retained on the wrist of the user by a convenient lanyard 12 having a slip lock 14, lanyard 12 being threaded through an opening 16 formed in a rearward extension 18 on the main body or casing 20 of light 10. Lanyard 12 may be replaced by a split ring (not shown) or any other suitable attachment, for wearing or storing light 10 on a belt-looped snap hook (not shown) or other device. In addition to casing 20, the remaining three modules of the invention include a lens cap 22, a light assembly module 24 and a battery module 26, all as shown in FIG. 6. The material constituting casing and the opaque, exterior 28 of lens cap 22 is a hard tough plastic such as ABS (acrylonitrile butadiene styrene) while the transparent lens 30 and interior sidewall 32 of cap 22 may be one-piece molded of a polycarbonote.

Figure 9:
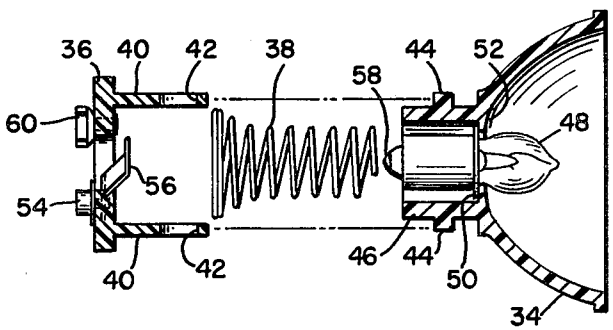
FIG. 9 is an exploded view of the light assembly module shown in FIG. 8.

Light assembly 24 is made up of a forward, combined reflector and light retainer 34, a base 36, and an electrically conductive compression spring 38, normally urging apart reflector 34 and base 36. The assembly 24 is retained together by a captive construction including a pair of opposed upstanding ears 40,40, each having a slot 42 therethrough for receiving a lug 44 formed on the light retaining body portion 46 of reflector 34. Reflector 34 is movable between a non-conductive open circit position shown in solid line in FIG. 8 to a conductive, closed circuit position illustrated by plantom lines in the same FIG. 8 defined by cntact of the free ends of ears 40,40 against the bottom periphery 35 of reflector 34. The light 48 is a conventional flashlight bulb, preferably a stock General Electric or Phillips PR-13 bulb. These bulbs have a convenient skirt 50 which is seated against internal flange 52 of body 46 (FIG. 9). A PR-3, PR-15 or PR-17 bulb might be used, but the PR-13 has the most desirable balance of the tradeoffs of brightness, running time and bulb life.

Base 36 and reflector 34 are made of a suitable molded non-conductive plastics material. The electrical circuit begins with one male quick-disconnect snap-fastener 54, conductively attached through base 36 and having a center spring leaf 56 arranged to contact base 58 of light bulb 48 when reflector 34 is depressed against base 36, (phantom lines, FIG. 8). The circuit is completed through the flange 52 and exterior wall of light bulb 48, compression spring 38 and a female, quick-disconnect snap-fastener 60, conductively attached through base 36. It should be noted here that a circuit is made without any need of conventional wiring or solder.

The battery module 26 includes a series-mounted arrangement of four otherwise conventional, size AA nickel-cadmium rechargeable batteries 62, packaged within a retaining frame 64 having output terminals in the form of another pair of male, female quick-disconnect snap-fasteners 66 and 68, respectively, for snapconnection with fasteners 60 and 54. Mating pairs of male-female, quick-disconnect snap-fasteners are reversely related as shown in order to assure proper polarity in assembly.

Figure 8:
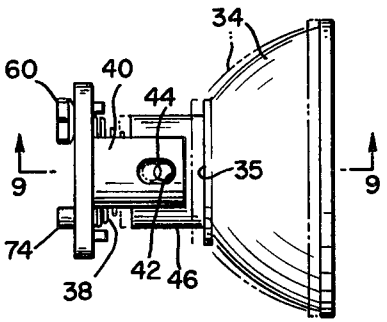
FIG. 8 is an elevation view of the light assembly module, taken along lines 8—8 of FIG. 7.
Figure 7:
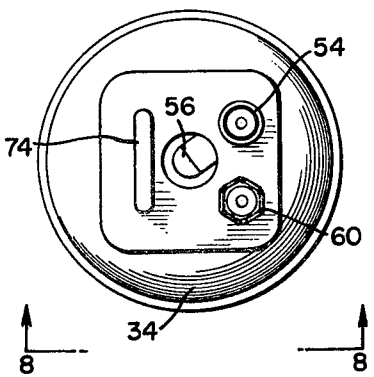
FIG. 7 is an interior view taken along lines 7—7 of FIG. 6.

Casing 20 and lens cap 22 are matingly internally threaded as shown in FIG. 8, and a casing 20 includes a peripheral recess 70 formed therearound, within which is retained an O-ring seal 22 to assure the watertight integrity of the assembled light 10.

Light 10 is assembled by snap-connecting light assembly module 24 and battery module 26 together, after which the assembly is dropped into casing 20. Lens cap 22 is then threaded onto casing 20, over O-ring seal 72. Base 36 is maintained in an aligned fashion with reflector 34 by means of an abutment 74, formed beneath base 36 and resting against the top of battery frame 64 and having a height about the same as the pair of quick-disconnect snap-fastener contacts. Thus, base 36 is prevented from tilting when depressed against battery module frame 64 by spring 38. As lens cap 22 is threaded down tightly onto casing 20, reflector 34 will be depressed against base 36, to the phantom line position illustrated in FIG. 8 and the light 48 will be turned on. The light may be turned off merely by unthreading lens cap 22 about one-quarter of a turn. All the while, the watertight integrity of O-ring seal 72 will be maintained. Thus an external lens cap actuated switch means is provided without need of any conventional external or throughcasing switch conponents.

The rechargeable batteries 62 have an operational life of from one to one and one-half depending upon the type of light bulb 48 that is selected for use. When recharging becomes necessary, lens cap 22 is unthreaded from casing 20 and the connected light assembly and battery modules 24, 26 are dropped out of casing 20. Modules 24, 26 are then readily disconnected.

Figure 1:
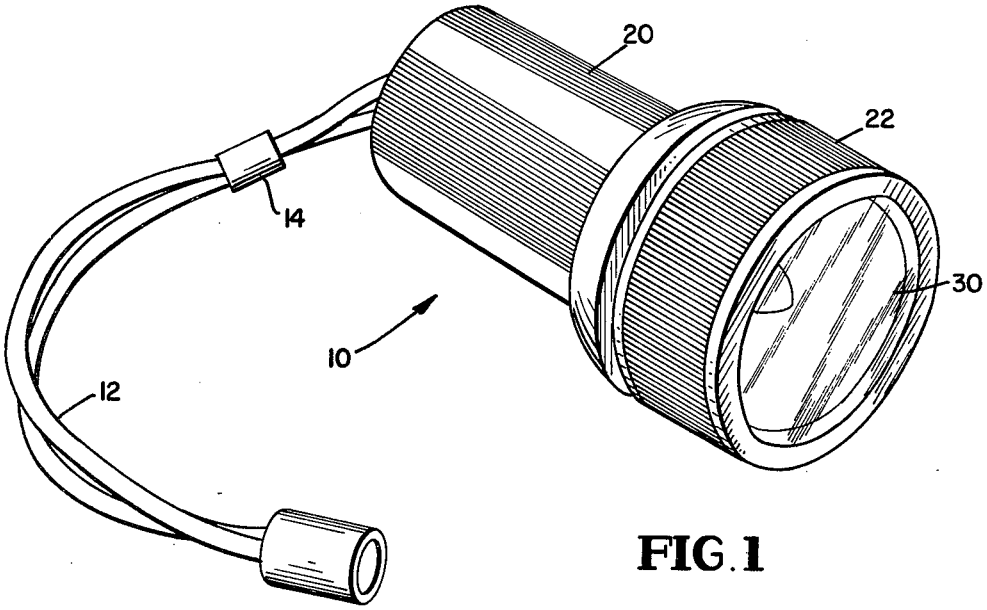
FIG. 1 is a perspective view of the invention.
Figure 4:
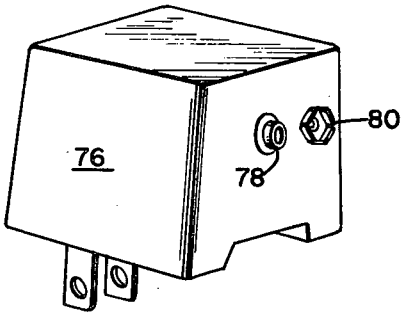
FIGS. 4 and 5 are perspective views of a 110 VAC and 12 VDC chargers constructed according to this invention, respectively.
Figure 5:
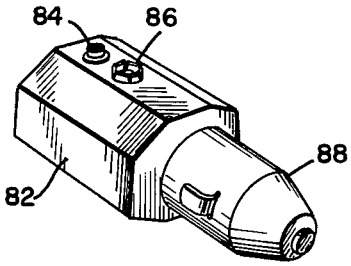
Figure 3:
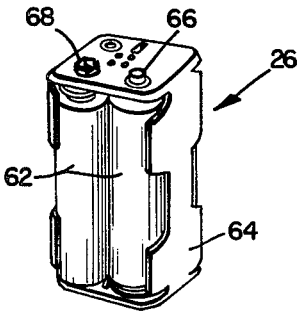
FIG. 3 is a perspective view of the rechargeable battery module of this invention.

A 110 VAC charger 76 (FIG. 4) having a pair of male-female, quick-disconnect snap fasteners 78, 80 mating with connectors 68, 66, respectively of battery module 26 is then connected to battery module 26. The charger is then plugged into a conventional 110 VAC oulet (not shown) whereupon the batteries 62 will be fully recharged after about 14–16 hours.

Alternatively, a 12 VDC charger 82 having similar mating snap-contacts 84, 86 might be used to recharge batteries 62. Charger 82 includes a male probe 88 which is inserted into the cigar lighter of an automobile (not shown).

If desired, one or more spare batery modules 26 could be provided for immediate replacement when the module in service needs recharging. Also, for conventional, non-rechargeable alkaline batteries could be used in place of the rechargeabke batteries 62. Such a battery module would have an operational life of about one and one quarter hours.

With the exception of the electrical connectors, the internal components of both charger 76 and 82 are conventional.

As stated hereinbefore, the modular component light of the present invention is remarkably small in size when compared with conventional, prior art flashlights and hand lanterns. In a preferred, commercial embodiment, the overal length of light 10 is merely 5 inches. Its width is one and ¾ inches and the lens cap is two and 178 inches in diameter. The light weighs but 8.75 ounces (including the batteries) and is about 1 oz. positively buoyant in water.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A flashlight comprising: battery means; casing means for housing said battery means; a lens cap engageable with said casing means; a light; assembly means for mounting said light; means for directly structurally and electrically interconnecting said battery means and said light assembly means together as a unitary assembly comprising a first pair of quick-disconnect electrical contact means on said battery means and a second, mating pair of quick-disconnect electrical contact means on said light assembly means, whereby said light assembly means and said battery means may also be readily disassembled for recharging or replacement of said battery means.

2. The flashlight claimed in claim 1 further comprising separate recharging means having electrical contact means thereon matable with said first pair of contact means on said battery means.

3. The flashlight claimed in claim 1 wherein each pair of quick-disconnect contact means comprise a male-female connector, the construction of first and second said pairs of connectors being in reversed relationship whereby only one manner of assembly of said battery means and light assembly means together is possible.

4. The flashlight claimed in claim 3 wherein said each pair of quick-disconnect contact means comprise a male-female snap fastener.

5. The flashlight claimed in claim 1, said casing means and lens cap including mating threading means for assembling said casing and lens cap together, said casing further including an O-ring seal fitted between said lens cap and casing for preventing water ingress within said casing.

6. The flashlight claimed in claim 1 wherein said light assembly means comprise a base, a unitary reflector and light holder, spring means urging said light and lens away from said base, and captive means limiting movement of said base and reflector toward and away from each other, whereby, in assembly with said battery means, said light is moved to a circuit closed position when said reflector is moved toward said base and a circuit open position when said reflector is moved away from said base.

7. The flashlight claimed in claim 6 wherein said spring means comprise an electrically conductive coil spring functioning as a part of the electrical circuit of said flashlight.

8. The flashlight claimed in claim 6, said lens cap and casing being so associated as to be externally moved toward and away from each other to thereby close and open the circuit of said flashlight and thus operate said flashlight.

9. The flashlight claimed in claim 6, said lens cap and casing being so associated as to be externally moved toward and away from each other to thereby close and open the circuit of said flashlight and thus operate said flashlight, one of said casing and said lens cap further including an O-ring seal fitted therebetween for preventing water ingress within said casing.

* * * * *

UNITED STATES PATENT AND TRADEMARK OFFICE

CERTIFICATE OF CORRECTION

PATENT NO. : 4,203,150

DATED : May 13, 1980

INVENTOR(S) : Ralph B. Shamlian

It is certified that error appears in the above-identified patent and that said Letters Patent are hereby corrected as shown below:

Column 1, line 8, "protable" should be -- portable --.

Column 1, line 18, "sonner" should be -- sooner --.

Column 2, line 19, "conjuction" should be -- conjunction--

Column 2, line 62, "polycarbonote" should be -- polycarbonate --.

Column 3, line 4, "circit" should be -- circuit --.

Column 3, line 5, "plantom" should be --phantom --.

Column 3, line 6, "cntact" should be -- contact --.

Column 3, line 16, "electrical" should be -- electric --.

Column 3, line 65, insert "hours" after -- one half --.

UNITED STATES PATENT AND TRADEMARK OFFICE

CERTIFICATE OF CORRECTION

PATENT NO. : 4,203,150

DATED : May 13, 1980

INVENTOR(S) : Ralph B. Shamlian

It is certified that error appears in the above-identified patent and that said Letters Patent are hereby corrected as shown below:

Column 4, line 8, "oulet" should be -- outlet --.

Column 4, line 19, "rechargeabke" should be -- rechargeable --.

Column 4, line 29, "overal" should be -- overall --.

Column 4, line 31, "178" should be -- 1/2 --.

Signed and Sealed this

*Fifth* Day of *August 1980*

[SEAL]

*Attest:*

SIDNEY A. DIAMOND

*Attesting Officer*

*Commissioner of Patents and Trademarks*